United States Patent [19]

Wehking et al.

[11] 4,388,005

[45] Jun. 14, 1983

[54] METHOD AND APPARATUS FOR PRINTING PARTIALLY OVERLAPPING CHARACTERS

[75] Inventors: Hans Wehking, Jerxheim; Detlef Eichler, Braunschweig; Wolfgang Klingenberg, Lahstedt, all of Fed. Rep. of Germany

[73] Assignee: Olympia Werke AG, Wilhelmshaven, Fed. Rep. of Germany

[21] Appl. No.: 257,479

[22] Filed: Apr. 17, 1981

[30] Foreign Application Priority Data

Apr. 17, 1980 [DE] Fed. Rep. of Germany ..... 3014769

[51] Int. Cl.[3] ..... B41J 1/30; B41J 29/36

[52] U.S. Cl. ..... 400/144.2; 400/697; 400/323

[58] Field of Search ..... 400/144.2, 697, 697.1, 400/322, 323, 320

[56] References Cited

U.S. PATENT DOCUMENTS 4,307,971 12/1981 Kane et al. ..... 400/697
4,311,398 1/1982 Gerjets ..... 400/697 X

FOREIGN PATENT DOCUMENTS 2906135 8/1980 Fed. Rep. of Germany ..... 400/697
2013576 8/1979 United Kingdom ..... 400/697

*Primary Examiner*—Paul T. Sewell

*Attorney, Agent, or Firm*—Spencer & Kaye

[57] ABSTRACT

Plural imprints of a selected character on a record carrier medium, which imprints are close together, mutually offset and partially overlapping, are generated in an office machine printer equipped with a typing element, in order to correct misprints or produce bold face prints. The printer is arranged to produce lines of typed characters, and to effect relative movement along a typing line between the typing element and the record carrier medium, by a sequence of operations composed of: effecting an initial relative movement between the typing element and the record carrier medium in a first direction along the printing line to an initial position, and generating at least one imprint of the selected character; effecting a second relative movement between the typing element and the medium by a given number of elemental steps, which number is equal to at least one, each having a length which is a fraction of the spacing between successive characters on a typed line, in the first direction from the initial position to a second position; and effecting a third relative movement between the typing element and the medium by the same number of elemental steps as the second movement, in a second direction, opposite to the first direction, along the printing line, from the second position to a third position, and generating at least one further imprint of the selected character.

7 Claims, 7 Drawing Figures

FIG.1
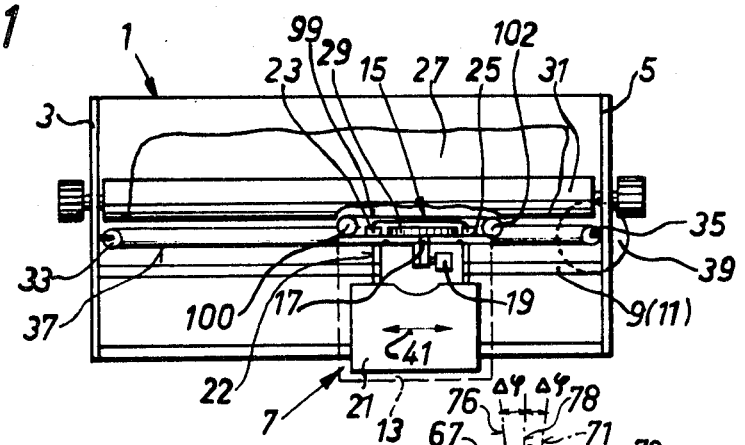
FIG.4
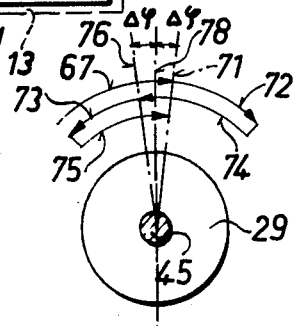
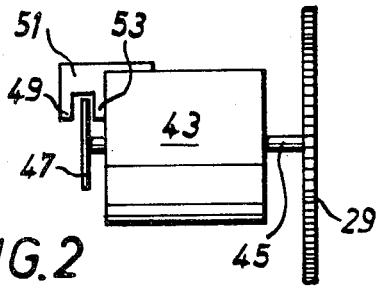
FIG.2
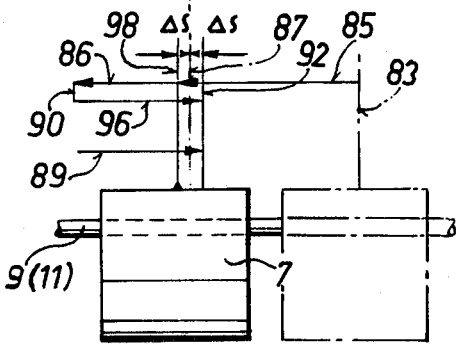
FIG.5
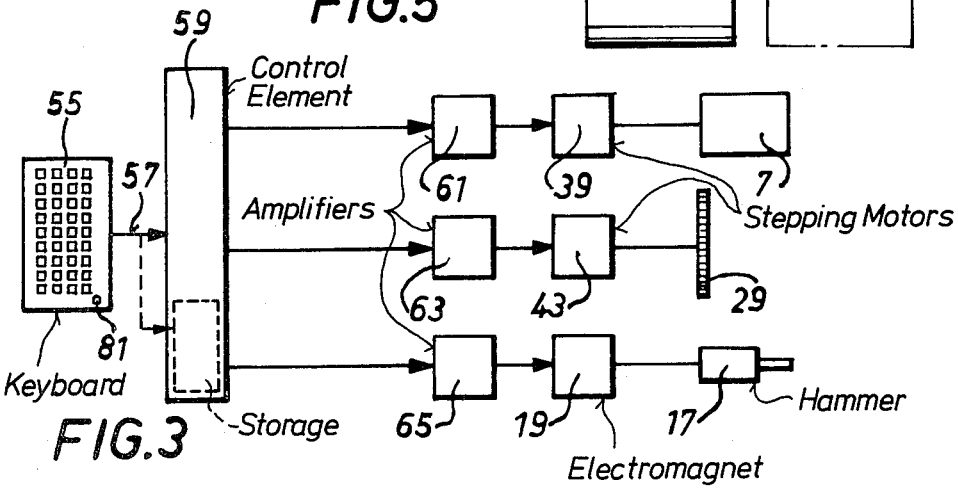
FIG.3

METHOD AND APPARATUS FOR PRINTING PARTIALLY OVERLAPPING CHARACTERS

BACKGROUND OF THE INVENTION

The invention relates to a method and apparatus for printing characters so that successive characters are printed closely together in an offset and partially overlapping manner on a record carrier in typewriters or similar office machines.

In typewriters or similar office machines having an erasing, or "self-correcting", system, it is necessary in order to lift off an erroneously printed character by means of a lift-off tape, for the position of the type carrier carriage to be in precise coincidence with the position which it had during printing of that character. A lateral deviation of even 1/100 mm already leaves a residual outline of the character which, although narrow, is clearly visible. For this reason, it is important that the carriage, which is driven, for example, by a motor, be positioned with great precision at all times.

German Patent Application P 29 06 135.6, and counterpart copending U.S. application Ser. No. 121,721, now U.S. Pat. No. 4,311,398, discloses a printing mechanism for realizing an imprint with uniform character spacing wherein after the setting step, the type carrier always performs a pilgrim step-type movement in the same direction with the same step length. This results in identical stopping conditions since any possible play always influences the character position in the same direction. In that proposed printing mechanism, the carriage performs a pilgrim step-type movement if an erroneously printed character is to be removed from the record carrier.

While this printing mechanism makes possible significantly improved corrections compared to other commercially available machines, there still sometimes appears a residual character outline which is visible on the record carrier medium. A further drawback is that this arrangement operates effectively only in one direction and is therefore direction dependent. To emphasize a word or individual words within a brief, the prior art machines produce partially overlapping characters for which special and unidirectionally operating arrangements are used.

SUMMARY OF THE INVENTION

It is an object of the invention to provide a typewriter or similar office machine which can produce partially overlapping characters and which can be used for printing operations that are independent of direction.

The above and other objects are achieved, according to the invention, by generating plural imprints of a selected character on a record carrier medium, which imprints are close together, mutually offset and partially overlapping, in an office machine printer equipped with a typing element, the printer being arranged to produce lines of typed characters, and to effect relative movement along a typing line between the typing element and the record carrier medium, plural imprints being generated in the following manner:

effecting an initial relative movement between the typing element and the record carrier medium in a first direction along the printing line to an initial position, and generating at least one imprint of the selected character;

effecting a second relative movement between the typing element and the medium by a given number of elemental steps, each having a length which is a fraction of the spacing between successive characters on a typed line, in the first direction from the initial position to a second position; and effecting a third relative movement between the typing element and the medium by the same number of elemental steps as the second movement, in a second direction, opposite to the first direction, along the printing line, from the second position to a third position, and generating at least one further imprint of the selected character.

Thus, the movements imparted to the typing element between imprints can be considered as a type of "pilgrim step" movement. Preferably the typing element is mounted on a carriage and the above described movements are imparted to the carriage. In each of the initial and third positions, a similar movement can be imparted to the typing element relative to the carriage, as will be described below.

When the invention is incorporated in a typewriter having a self-correcting system, the erroneously printed characters are completely removed from the record carrier, since the effect of any play on the positioning of the type carrier relative to the record carrier medium is eliminated in the simplest manner in both directions. This does not require excess additional expenditures for the control elements. This system can simultaneously be used to produce bold face printing without requiring a separate arrangement for this purpose and high additional costs.

BRIEF DESCRIPTION OF THE DRAWING

FIG. 1 is a simplified top plan view of a system according to a preferred embodiment of the present invention.

FIG. 2 is a side elevational detail view of a portion of the structure of FIG. 1.

FIG. 3 is a block circuit diagram of one embodiment of a control device according to the invention.

FIGS. 4 and 5 are detail views illustrating two types of movement according to the invention.

DESCRIPTION OF THE PREFERRED EMBODIMENTS

Figure 6:
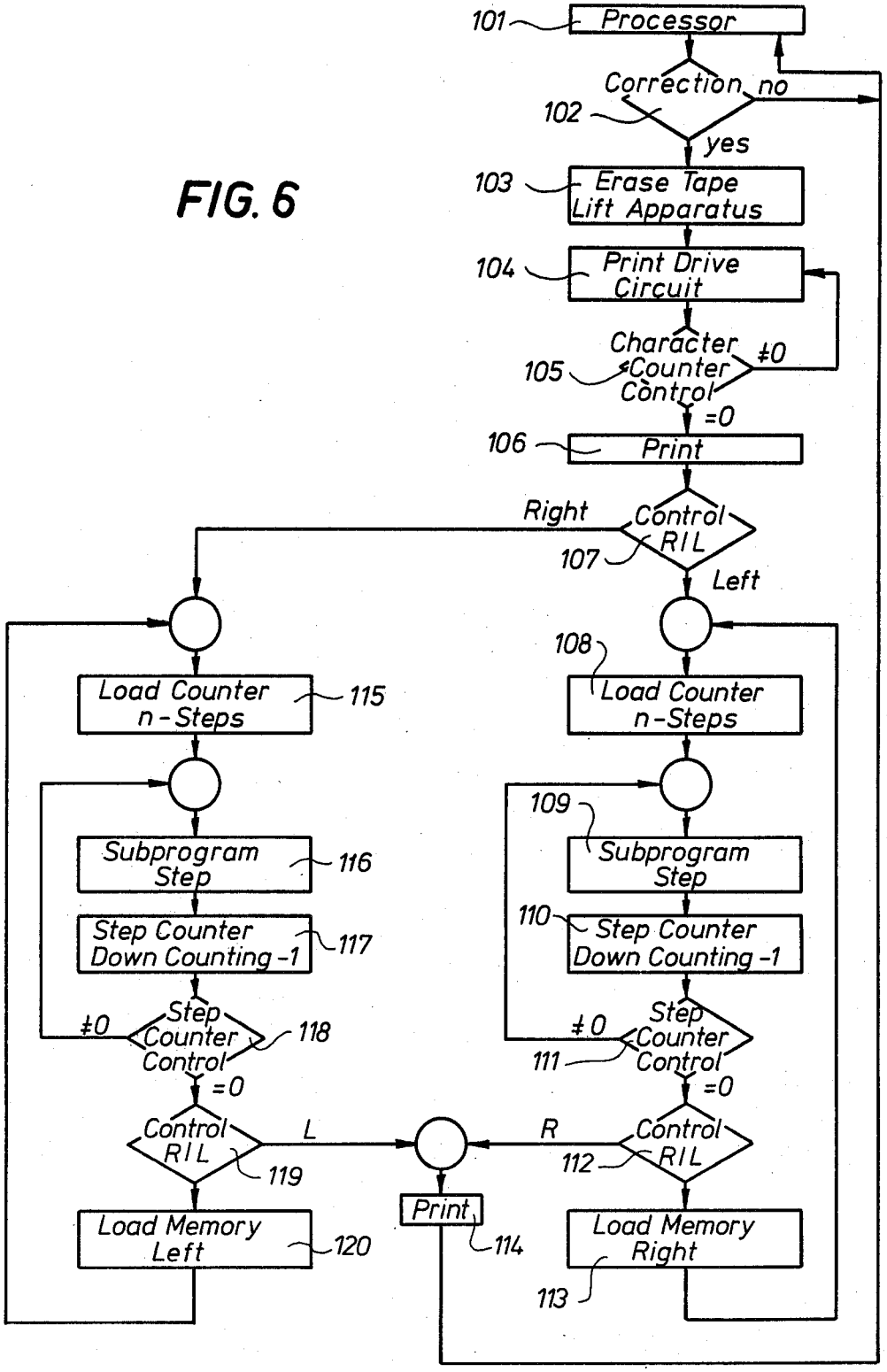
FIG. 6 comprise a flow diagram, of the program executed by the processor comformable to FIG. 4 and FIG. 7 comprise a flow diagram of the program executed by the processor comformable to FIG. 5.

FIG. 1 is a top view of a daisy wheel printer 1 according to the invention having side walls 3 and 5 between which a carriage 7 is mounted for longitudinal displacement on shafts 9 and 11, shaft 11 being located behind shaft 9. The carriage 7 includes a base plate 13 carrying a type wheel drive arrangement 15 and a type striking device composed of a printing hammer 17 and an electromagnet 19. A daisy wheel 29 is rotatably mounted on arrangement 15. On the base plate 13 there is also disposed a ribbon cassette 21 with a ribbon 22 which passes, via guides 23 and 25, betwen a record carrier medium, i.e. a paper sheet, 27 and the rotatably mounted type wheel 29.

The base plate 13 also carries a correcting mechanism which includes an erasing, or lift-off, tape 99, a supply reel 100, and takeup reel 102, and a transporting device (not shown) for advancing tape 99 from reel 100 to reel 102. This mechanism can be constructed in a known manner.

The record carrier medium 27 is driven in a known manner by means of a platen 31 which itself is driven via a motor (not shown). In the side walls 3 and 5 there are rotatably mounted two driving gears 33 and 35 which rotate about vertical axes and cooperate in a form-locking manner with a toothed belt 37 one reach of which is permanently connected to the carriage 7. The gear 35 can be driven in both directions 41 for moving carriage 7 along platen 31 in a stepwise manner via a motor, e.g. a stepping motor 39.

The type wheel 29 is provided with a plurality of elastic type arms with type faces of the characters arranged at their free ends. Within the scope of the invention, wheel 29 could be replaced by a typing ball or a cylindrical typing element. Similarly, each type face could be carried by an individual lever, in a known manner.

The type wheel 29 can be rotated in steps by means of a motor, e.g. a stepping motor 43 shown in FIG. 2, which can be operated in a start-stop manner. Wheel 29 is fastened to one end of the shaft 45 of motor 43 and at the other end of the driven motor shaft 45 there is provided an optical coding disc 47 which cooperates with a light source 49 and a plurality of light-sensitive receiving elements 53 disposed in a housing 51 carried by motor 43.

As shown in FIG. 3, signals 57 coded to correspond to characters to be printed are conducted from a keyboard 55 to a control element 59 which may be a microprocessor or a commercially available computer. The control element 59 receives the data, performs certain calculations and emits driving pulses via amplifiers 61 and 63 to the carriage stepping motor 39 and to the type wheel stepping motor 43. When the carriage stepping motor 39 has been supplied with twelve driving pulses in a system where the carriage advances in half steps, the carriage will have moved on by one character space of a 1/12 inch pitch typing line. The type wheel stepping motor 43 requires four driving pulses to rotate the type wheel through an angle equal to the type arm spacing. The electromagnet 19 for the hammer 17 likewise receives its driving pulses via an amplifier 65 from the control element 59.

Control element 59, and the printer composed of carriage 7, wheel 29 and the driver therefore, can be of a known type such as, for example, a modified version of the control device and printer components disclosed in U.S. Pat. No. 4,030,591, Martin et al.

To make a correction of an erroneously printed character by renewed striking with the intervention of a lift-off tape, it is necessary for the character to be corrected, and thus also the carriage, to always take on the same position which it had at the time the character was printed. In spite of the fact that this desired precise positioning of the carriage 7 is practically impossible to achieve every time, complete removal of the erroneously printed character can be achieved according to the invention by control element 59, by actuation of a correction key 81, in such a manner that in the operating position of the correction device the same print type face is struck at least twice in direct time succession, between which strikes a relative movement takes place in the direction along the printed line between the record carrier medium 27 and the surface of the print type face in such a manner that the mutually offset correction imprints at least partially overlap.

Such a correction therefore requires the following steps:

(a) setting the carriage 7 together with the type disc 29 into the printing position of the character to be erased;

(b) bringing the lift-off tape 99 from a rest position to an operating position between the type disc 29 and the record carrier medium 27, and making the first print with the selected print type face by means of the printing hammer 17 which is driven by the electromagnet 19;

(c) performing a relative movement between the surface of the print type face and the record carrier medium 27 by a few elemental steps, each covering a fraction of a switching step, from the printing position in the same direction as the immediately previously occurring relative movement between the carriage 7 and the record carrier medium 27, then performing an oppositely directed relative movement by the same number of elemental steps into the printing position, and printing with the selected print type face a second time; and (d) resetting the correction device into its rest position.

The above-described correction process is suitable for a direction-independent printing operation with the play resulting due to mechanical or control engineering reasons between the stepping motor 39, the cable 37 and the carriage 7 being nullified in the simplest manner for both displacement directions.

As shown in FIG. 5, this sequence can be performed by bringing carriage 7, by operation of motor 39, from position 83 in the direction of the arrow 85 into the printing position 98. This can be effected, for example, by actuation of a back space key on the keyboard 55. Because of the above-mentioned play, the carriage 7 normally does not reach the desired ideal printing position 87, but instead a position 98 which differs from the printing position 87 by a fraction, $\Delta s$, of a switching step. A switching step is equal in length to the distance between successive characters on a typed line. Then the correction key 81 on the keyboard 55 is actuated and this causes the control element 59 to bring the correction device into the operating position and to send an actuation signal, via amplifier 65, to the electromagnet 19. This causes printing hammer 17 to produce a first erasing imprint on the record carrier medium 27.

Then the control element 59 causes the carriage 7 to travel over the path represented by arrow 86 in the same direction as the last performed movement 85 from the position 98 by a few elemental steps, which are each equal to the fraction $\Delta s$ of a switching step, to position 90, and thereafter an opposite positioning adjustment is effected from position 90 to the second printing position 92 by effecting the same number of elemental steps. By moving the carriage in the direction of the arrow 96, the above-mentioned unavoidable play is eliminated in the opposite direction where the position 92 differs from the ideal printing position 87 by the fraction $\Delta s$ of a switching step. The second imprint of the selected print type face is effected in position 92. After this second imprint, the correction device is set back to its rest position.

By making use of the play in the carriage setting device to offset the carriage in both directions by $\Delta s$ with respect to the ideal printing position 87, and effecting double striking of the selected typeface, the character to be corrected is lifted off completely. The arrangement according to the invention is suitable for direction-independent printing operation where, when the printing position 87 is approached in the direction of arrow 89, the first step of the to-and-fro step movement is also performed in the direction of arrow 89. The first imprint is here made with the carriage in position 92. Then the carriage is further displaced in the direction of arrow 89 to, for example, position 83, followed by displacement in the reverse direction to position 98 where the second lift-off imprint is made.

In the above-described correction process it has been assumed that the type wheel 29 is set directly by the motor 43 and therefore no play exists between the type wheel and the motor. If, however, the type wheel 29 is set by a motor via an elastic intermediate member, accurate correction can be realized by striking the lift-off tape at least twice with the selected type face in each of the imprinting positions of carriage 7, in direct succession in time. The type wheel is repositioned prior to each imprint at each carriage position.

Thus, in a first operating position, for example with carriage 7 in position 98, the type wheel is first rotated in the direction of arrow 67 to bring the selected type face into position 71 which is angularly offset beyond the ideal angular position 78 due to the existing play. Angular position 71 is offset from position 78 by the angle $\Delta\rho$. The selected type face is then struck for the first time.

The control device 59 then causes the type wheel 29 to perform a to-and-fro, or pilgrim, step as shown in FIG. 4. To do this, the type wheel executes a rotary movement consisting of a few elemental steps in the last performed positioning direction from the printing position 71 in the direction of arrow 72 and, thereafter an oppositely directed positioning movement, in the direction of arrow 74, by the same number of elemental steps into the printing position 76, whereupon the type face is again struck. Each elemental step is equal in length to a selected fraction of a switching step, a switching step being equal to the type wheel arm spacing.

Due to the existing play printing position 76 is also angularly offset by $\Delta\rho$ from the ideal position 78, but in the opposite direction from position 71.

After this setting process for the type wheel 29, the carriage 7 performs the above-mentioned pilgrim step movement defined by arrows 86 and 96 as shown in FIG. 5, and after carriage 7 reaches the second operating position 92, a first imprint of the selected type face is made. Before making the second imprint while carriage 7 remains in the second position, the type wheel 29 performs a pilgrim step movement, defined by arrows 73 and 75, into position 71, as described above.

The type wheel 29 thus executes a pivotal movement from the angular position 76 in the direction of the arrow 73 by a few elemental steps in the last performed positioning direction and then performs an oppositely directed movement in the direction 75 by the same number of elemental steps into the angular position 71. Due to the movement of the type wheel 29 in the direction of arrow 75, the play in the setting device for the type wheel 29 is eleminated in the other pivotal direction. Now the control element 59 actuates, via amplifier 65 and electromagnet 19, the hammer movement of the printing hammer 17 and thus produces the second erasing imprint on the record carrier medium 27.

Due to the fact that the selected type face impacts twice in immediate succession in time in both operating positions of the carriage 7 as well as of type wheel 29, it is assured that the erroneously printed character is completely removed. The play in both directions resulting from mechanical and control engineering conditions is eliminated in the simplest way without complex control mechanisms.

The combination of the pilgrim step movement of the carriage with the pilgrim step movement of the type carrier and the four strikes of the character to be corrected are recommended if the drive mechanisms for both the carriage and the type wheel exhibit play.

The above-described pilgrim step movement of the carriage 7 or of the type wheel 29 can also be used to produce bold face printing. In this case, after positioning the wheel 29 and the carriage 7 in the line direction in front of the desired printing position on the record carrier medium 27 and printing the selected character, a relative movement takes place between the wheel 29 and the record carrier medium 27 by a few elemental steps which may be only a fraction of a switching step, from the current printing position in the last performed relative positioning movement direction, and thereafter an oppositively directed relative position movement by the same number of elemental steps into the printing position, followed by renewed printing of the selected character.

When a character or a word in a preceding line are to be corrected, the platen can be controlled to perform a similar pilgrim step movement such that when a line is approached from the direction opposite to that in which successive lines are printed, the platen 31 is rotated in that direction more than is necessary. Then the rotary movement of the platen 31 is reversed to arrive at the desired line, and the correction can then be made according to one of the above-described methods.

The UK Patent Application No. 20 13 576 which published on Aug. 15, 1978, discloses a suitable memory, preferably in association with an office machine of the type contemplated by the invention.

FIG. 6 comprises a flow diagram of the program executed by the processor conformable to the UK Pat. Appl. No. 20 13 576 and to FIG. 4. Referring to FIGS. 4 and 6 after the type wheel 29 is brought, from the old set position in the direction of arrow 67, into the printing position, the printing hammer is caused to produce a first erasing imprint on the record carrier medium 27. Then the type wheel is caused to execute a step movement comformable to the flow diagram which will now be explained.

The processor 101 transfers a signal to the controller 102 'correction', which sends a correction code to erase tape lift apparatus 103 and then to print drive circuit 104. When the character control 105 is "0", a signal is transferred to printing mechanism 106. The printing hammer produces a first erasing imprint on the record carrier medium 27. When the type wheel has been brought in the direction 'Left' in the printing position, the controller 107 transfers a signal to load counter 108, which is loading for 'n' steps. If the step counter 110 is down counted, a signal is transferred to the controller 111. The controller 112 transfers a signal to load memory 113. This memory 113 causes the counter 108 to load for 'n' steps. The subprogram 109 drives the motor 43 in arrow 74. The steps in the arrow 72 and in the arrow 74 are equal. The ideal position 78 is not arrived at. This is the result of play existing in the system transmitting movement to the type wheel. If the counter 111 is once more down counted, the controller 112 gives a signal to print mechanism 114. This causes printing hammer 17 to produce a second imprint on the record carrier medium 27. After this second imprint, the correction device 103 is set back to its rest position. By making use of the play in the type wheel driving mechanisms to offset the type wheel in both directions by Δs with respect to the ideal printing position 78, and effecting double striking of the selected typeface, the character to be corrected is lifted off completely.

When the type wheel is brought in the direction 74 in the first printing position 76, the controller 107 transfers a signal to counter 115. The subprogram 116 counts down the counter 118 to zero. The controller 119 gives a signal to memory 120 or to the printing mechanism as described above.

Figure 7:
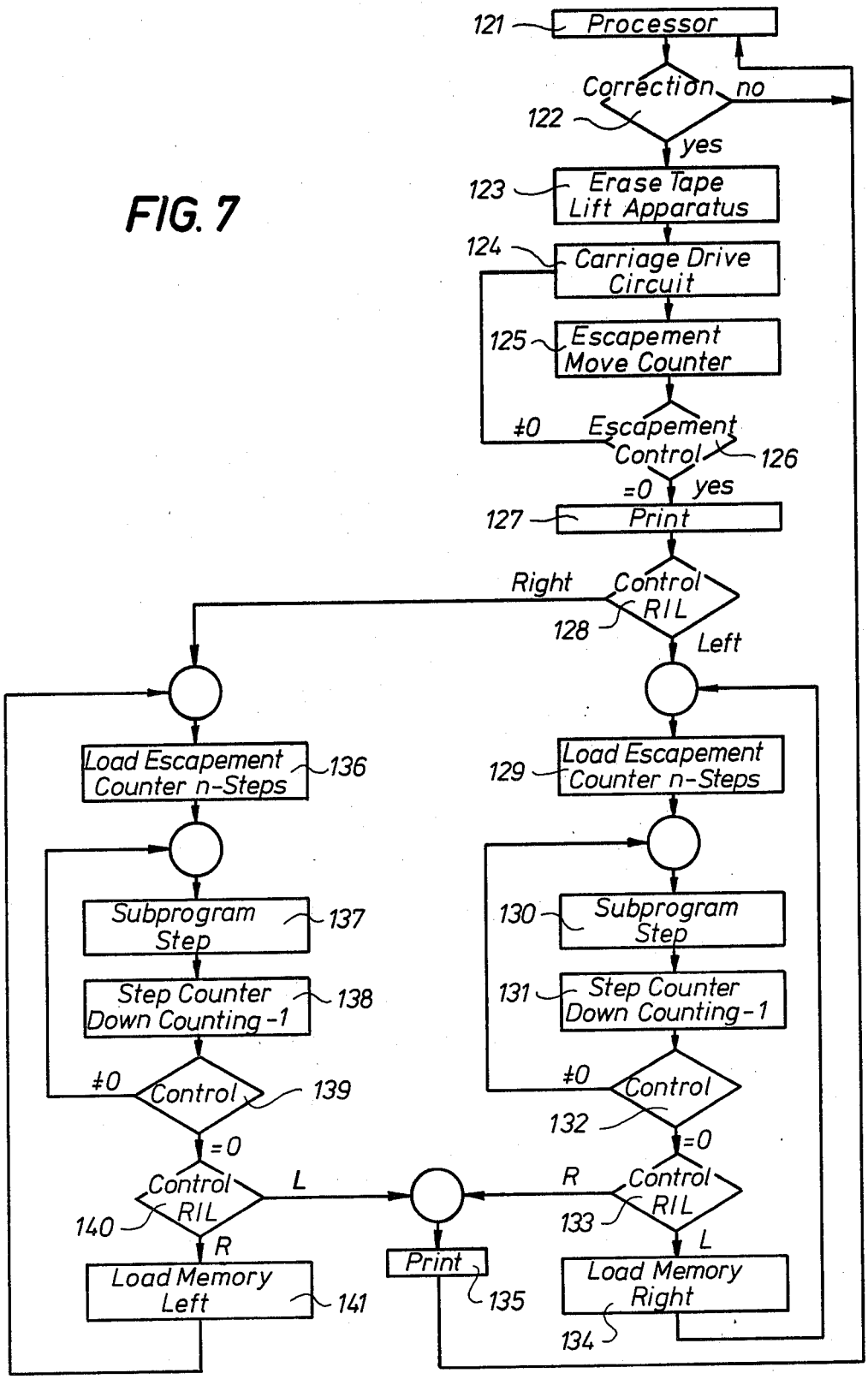

FIG. 7 shows a flow diagram similar to FIG. 6 for the carriage movement as shown in FIG. 5. The processor 121 transfers a signal to the controller correction 122 which sends a correction code to erase tape lift apparatus 123. This gives a signal to the carriage drive circuit 124. The escapement move counter 125 is controlled by the controller 126. When the carriage control is "0", a signal is transferred to the printing mechanism for the first imprint on the medium 27 in the position 98. This position 98 lies behind the ideal position 87 as a result of play in the carriage driving mechanism. After the first imprint the controller 128 transfers a signal to load escapement counter 129. This counter 129 is loaded for n-steps. The subprogram 130 causes the down counting of step counter 131. The controller 132 gives a signal to controller 133 which loads the memory 134 by signal 'L'. The memory 134 transfers a signal to the escapement counter 129 giving signals to the counter 131 and to the controllers 132 and 133. The controller 133 transfers a signal to the printing mechanism 135 causing production of a second imprint on the medium 27.

When the carriage is brought in the direction 89 in the first printing position 92, the controller 128 is sends a signal to escapement counter 136. The subprogram 137 drives the counter 138 down. The controller 139 gives a signal to controller 140 deciding to send a signal to memory 141 or to the printing mechanism 135. After arriving at the second print position 98, the controller 140 transfers a signal 'L' to the printing mechanism to actuate the printing hammer 17. By making use of the play in the carriage driving system to offset the carriage in both directions by Δs with respect to the ideal position 87 and effecting double striking of the selected typeface, the character to be corrected is lifted off completely.

The above-described step movement of the carriage 7 or of the type wheel 29 can also be used to produce bold face printing.

When the carriage moving system and the type wheel moving system have no plays, the carriage and the type wheel arrive at the "ideal" positions 87 and 78. But the moving systems as describing above have always plays. Therefore the carriage and the type wheel arrive at positions ahead of their "ideal" positions. The second and the third relative movement between the typing element and the record carrier medium consist of at least one elemental step.

It will be understood that the above description of the present invention is susceptible to various modifications, changes, adaptions, and the same are intended to be comprehended within the meaning and range of equivalents of the appended claims.

What is claimed is:

1. A method for generating plural imprints of a selected character on a record carrier medium, which imprints are close together, mutually offset and partially overlapping, in an office machine printer equipped with a typing element, the printer being arranged to produce lines of typed characters, in which method a relative movement takes place along a typing line between the typing element and the record carrier medium, said method comprising, in the order recited:

effecting an initial relative movement between the typing element and the record carrier medium in a first direction along the typing line to an initial position, and generating at least one imprint of the selected character;

effecting a second relative movement between the typing element and the medium by a given number of elemental steps, which number is equal to at least one, each having a length which is a fraction of the spacing between successive characters on a typed line, in the first direction from the initial position to a second position; and effecting a third relative movement between the typing element and the medium by the same number of elemental steps as said second movement, in a second direction, opposite to the first direction, along the typing line, from the second position to a third position, and generating at least one further imprint of the selected character.

2. A method as defined in claim 1 for removing erroneously typed characters in an office machine equipped with a correcting device including an erase ribbon, the printer including a carriage carrying the typing element and mounted in the machine for movement relative to the medium along the typing line, the machine including a drive device for effecting such movement of the carriage, a memory for storing a representation of at least one of the characters to have been last printed, an ink ribbon, a control device for producing signals for setting the position of the typing element, and means providing an erase signal for bringing the erase ribbon into position to cooperate with the typing element in place of the ink ribbon and for setting the typing element to effect imprint of the character to be erased, wherein said step of effecting an initial relative movement is carried out by effecting such relative movement between the carriage and the medium and comprises bringing the erasing tape into operative association with the typing element in place of the ink ribbon before generating the first-recited imprint, and further comprising withdrawing the erasing ribbon from operative association with the typing element after said step of generating a further imprint.

3. A method as defined in claim 2 wherein: the printing element is a daisy wheel rotatably mounted on the carriage and provided with a plurality of radially spaced elastic arms each bearing a type face of a respective character; the printer further includes a motor connected to rotate the wheel in steps to bring a selected type face into position to effect imprinting of its associated character; said step of effecting an initial relative movement and generating at least one imprint comprises bringing the carriage to the initial position, rotating the wheel in a first angular direction to bring the selected character type face into position to effect imprinting, generating a first imprint of the selected character, rotating the wheel in the first angular direction by a given number of elemental angular steps, which number is equal to at least one, each having a magnitude which is a fraction of the radial distance between adjacent wheel arms, rotating the wheel by the same number of elemental angular steps in a second angular direction, opposite to the first angular direction, and generating a second imprint of the selected character; said step of effecting a second relative movement is carried out by effecting such relative movement between the carriage and the medium; and said step of effecting a third relative movement and generating at least one further imprint comprises effecting such relative movement between the carriage and the medium to the third position, generating a first further imprint of the selected character, rotating the wheel in the second angular direction by a given number of angular steps each having a magnitude which is a fraction of the radial distance between adjacent wheel arms, rotating the wheel by the same number of elemental angular steps in the first direction, and generating a second further imprint of the selected character.

4. A method as defined in claim 1 wherein: the printer includes a carriage mounted in the machine for movement relative to the medium along the typing line; the printing element is a daisy wheel rotatably mounted on the carriage and provided with a plurality of radially spaced elastic arms each bearing a type face of a respective character; the printer further includes a motor connected to rotate the wheel in steps to bring a selected type face into position to effect imprinting of its associated character; said step of effecting an initial relative movement and generating at least one imprint comprises bringing the carriage to the initial position, rotating the wheel in a first angular direction to bring the selected character type face into position to effect imprinting, generating a first imprint of the selected character, rotating the wheel in the first angular direction by a given number of elemental angular steps, which number is equal to at least one, each having a magnitude which is a fraction of the radial distance between adjacent wheel arms, rotating the wheel by the same number of elemental angular steps in a second angular direction, opposite to the first angular direction, and generating a second imprint of the selected character; said step of effecting a second relative movement is carried out by effecting such relative movement between the carriage and the medium; and said step of effecting a third relative movement and generating at least one further imprint comprises effecting such relative movement between the carriage and the medium to the third position, generating a first further imprint of the selected character, rotating the wheel in the second angular direction by a given number of angular steps, each having a magnitude which is a fraction of the radial distance between adjacent wheel arms, rotating the wheel by the same number of elemental angular steps in the first direction, and generating a second further imprint of the selected character.

5. In an office machine including a correcting device, a carriage carrying a printing element, means supporting the carriage for movement parallel to a record carrier medium for permitting the production of lines of typed characters, means operable for causing the printing element to imprint a selected character on the medium, a drive device connected for effecting such movement in a step-like manner, and means for producing signals indicating production of typed characters, the improvement comprising: means including a correcting key actuable for producing a signal indicating that an erroneously typed character is to be removed; and a control device connected to receive the signals indicating production of typed characters for advancing said carriage in the line typing direction, and for supplying movement-initiating stepping pulses to said drive device in response to production of a signal by said means including a correcting key, for operating said drive device and said imprint causing means by sequentially: effecting an initial movement of said carriage relative to the record carrier medium in a first direction along the printing line to an initial position; generating at least one imprint of the character to be removed; supplying a given number of stepping pulses to said drive device for effecting a second movement of said carriage relative to the medium by the given number of elemental steps, which number is equal to at least one, each having a length which is a fraction of the spacing between successive characters on a typed line, in the first direction from the initial position to a second position; supplying the same given number of stepping pulses to said drive device for effecting a third movement of said carriage relative to the medium by the same number of elemental steps as the second movement, in a second direction, opposite to the first direction, along the printing line, from the second position to a third position; and generating at least one further imprint of the character to be removed, whereby as a result of play existing in the movement of said carriage, there are produced, on the medium, multiple imprints of the character which are close together, mutually offset and partially overlapping.

6. A machine as defined in claim 4 wherein said control device comprises a microprocessor.

7. A machine as defined in claim 5 or 6 wherein said drive device comprises a motor rotatable in steps and an endless transmission element connected between said motor and said carriage for moving said carriage in steps corresponding to the rotation steps of said motor.

* * * * *